United States Patent [19]

Evans

[11] Patent Number: 4,995,511

[45] Date of Patent: Feb. 26, 1991

[54] TOOTHBRUSH AND TOOTHPASTE HOLDER

[76] Inventor: Marilyn B. Evans, 200 W. Arbor Vitae #10, Inglewood, Calif. 90301

[21] Appl. No.: 531,759

[22] Filed: Jun. 1, 1990

[51] Int. Cl.[5] ..... B65D 85/00

[52] U.S. Cl. ..... 206/362.1

[58] Field of Search ..... 206/362.1, 362, 362.2, 206/362.3, 209.1

[56] References Cited

U.S. PATENT DOCUMENTS

| | | | |
|---|---|---|---|
| 1,781,247 | 11/1930 | Rickles | 206/362.1 |
| 2,437,781 | 3/1948 | Hagglund | 206/362.1 |
| 2,450,626 | 10/1948 | Beilock | 206/362.1 X |
| 3,727,748 | 4/1973 | Brown | 206/362.1 |
| 3,881,868 | 5/1975 | Duke | 206/209.1 |
| 4,817,826 | 4/1989 | Judge | 206/362.1 X |

*Primary Examiner*—William I. Price

*Attorney, Agent, or Firm*—Erik M. Arnhem

[57] ABSTRACT

A covered container for storing toothbrushes. The container includes a relatively long upstanding outer tube and a relatively short tube partially telescoped into the long tube to form an external shoulder around the tube surface. A tubular cover is adapted to fit over the short tube portion of the container, such that the outer surface of the cover forms a smooth continuation of the container side surface.

3 Claims, 1 Drawing Sheet

TOOTHBRUSH AND TOOTHPASTE HOLDER

BACKGROUND AND SUMMARY OF THE INVENTION

This invention relates to a free-standing covered container specially designed to store toothbrushes. In some respects the container is similar to the container shown in U.S. Pat. No. 3,881,868 to E. Duke.

A particular aim of the present invention is to provide an upright covered container wherein the outer side surface of the cover forms a smooth planar continuation of the outer side surface of the container. The external joint between the cover and the container is a relatively inconspicuous thin line, such that the upstanding structure has the appearance of a unitary smooth-surface block or cylinder (depending on the cross section selected for the container and cover).

Another aim of the invention is to provide a container construction that can be formed out commercially available flat stock or tube stock, with a minimum capital expenditure for tooling. In one form of the invention the container comprises a first elongated tube and a second relatively short tube partially telescoped into the first tube so that an upper edge portion of the short tube is exposed. A cover is formed by a third tube having the same cross-sectional size as the first tube. This third tube can be inserted downwardly onto the exposed surface of the second tube, such that the outer surfaces of the first and third tubes form a continuous uninterrupted surface.

THE DRAWINGS

DESCRIPTION OF A PREFERRED EMBODIMENT OF THE INVENTION

Figure 1:
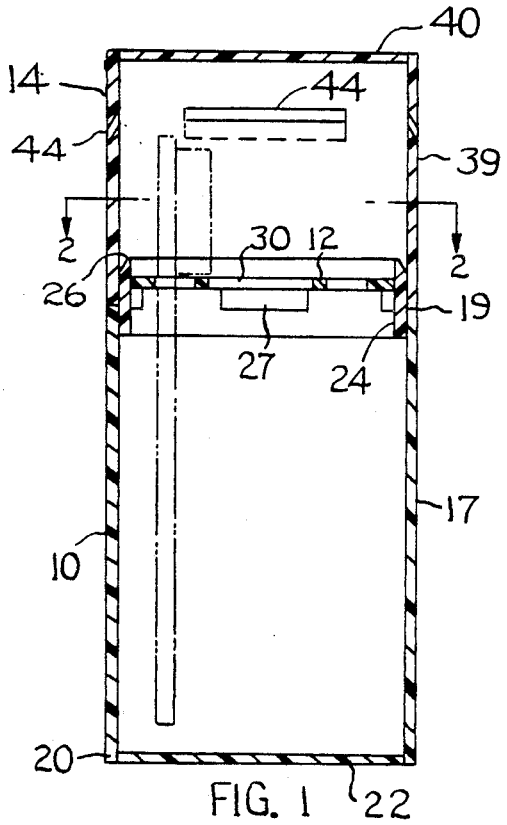
FIG. 1 is a sectional view taken through a covered container embodying the invention.
Figure 3:
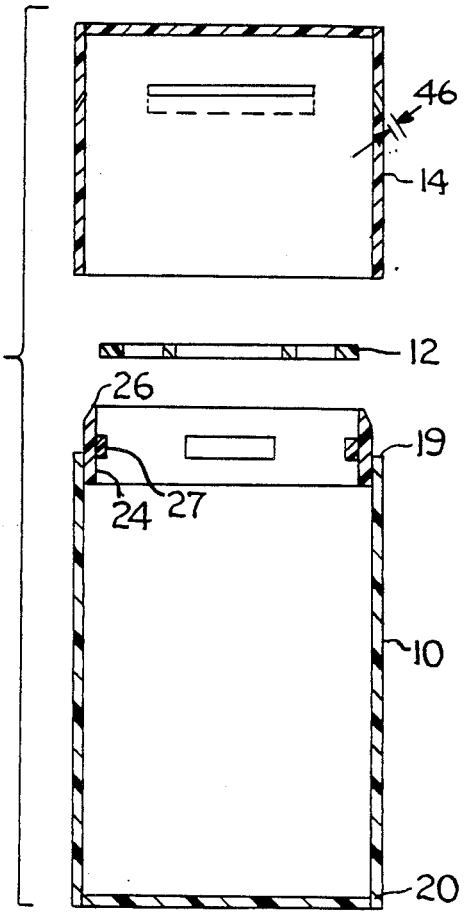
FIG. 3 is a sectional view taken in the same direction as FIG. 1, but with the components shown in an exploded condition.

The drawings show a covered container having three principal component parts, i.e. a container 10, removable plate 12, and removable cover 14. Each part is formed of an opaque (non-transparent) plastic material having a high surface luster. When the cover is inserted onto the container, as in FIG. 1, the covered container has the appearance of a smooth surfaced upright block devoid of projections or noticeable surface irregularities. The joint between the container and the cover is a thin inconspicuous horizontal line. The covered container is intended to be positioned on a bathroom counter, with toothbrushes and a tube of toothpaste concealed within the container. The toohbrushes are suspended from plate 12.

Container 10 is comprised of an upright tube 17 having an upper end 19 and a lower end 20; the tube has a square cross-section. The lower end of the tube is closed by a flat plastic wall element 22. A solvent adhesive may be used to make the connection.

Container 10 further comprises a second relatively short tube 24 partially telescoped into tube 17 so that the upper end 26 of the second tube is located above the upper end 19 of tube 17. A solvent adhesive may be used to secure the two tubes together.

Four square cross-sectional bars 27 are adhesively secured to the inner surface of tube 24 to form horizontal ledges spaced slightly below the upper end of the tube. A flat plate 12 is adapted to removably fit within tube 24 on the ledge elements 27. Plate 12 can be removed from tube 24 by finger action.

Figure 2:
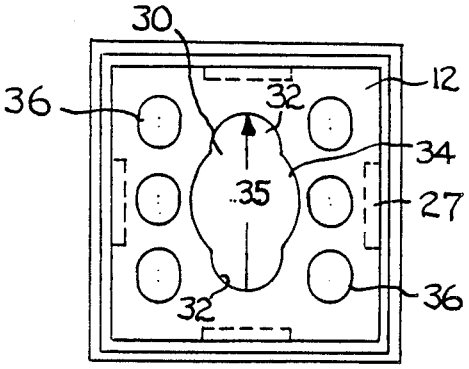
FIG. 2 is a transverse sectional view taken on line 2—2 in FIG. 1, but with the cover removed.

FIG. 2 shows a hole a hole construction 30 in plate 12 designed to permit easy removal of the plate from tube 24. Hole 30 comprises two spaced-apart semi-circular hole portions 32 and an intervening oval shaped hole portion 34. Hole portions 32 having a diameter dimensions of approximately three quarter inch. The length dimension 35 of the elongated hole 30 is slightly more than two inches.

The hole is configured so that a person can insert his first three fingers into the hole, with the first finger having snug engagement with the edge surface of one hole portion 32 at the first finger joint, and the third finger having snug engagement with the edge surface of the other hole portion 32 at the first finger joint. The second finger has a clearance fit within the oval shaped portion 34 of the hole.

The construction of hole 30 is designed to permit the person to easily lift plate 12 from the position on ledge elements 27, using only the ends of the first three fingers. The lifting action is balanced such that the plate maintains an essentially horizontal attitude during the lifting operation. Accordingly, the plate will not stick against the inner surface or corners of tube 24.

Plate 12 has six openings 36 adapted to individually receive the handle portions of toothbrushes, with the brush portions located above the plate for extraction from within the container. One toothbrush is shown in phantom in FIG. 1.

Cover 14 is comprised of a square cross-sectioned tube 39 having the same wall thickness and transverse dimension as tube 17. The upper end of tube 39 is closed by a transverse wall element 40. Cover 14 is adapted to be inserted onto the exposed portion of tube 24 so that an inner surface of tube 39 is in frictional facial contact with the outer side surface of tube 24. When cover 14 is inserted onto container 10 the outer side surface of tube 24 forms a smooth planar continuation of the outer surface of tube 17.

Four vent slots 44 are formed in tube 39. Each vent slot extends angularly to the plane of the tube wall. Also, each slot has a width dimension 46 that is narrower than the wall thickness dimension of the tube. These factors enable the vent slots to have sufficient area while at the same time being relatively inconspicuous.

The covered container is an attractive structure for effectively concealing toothbrushes from view, while at the same time having the toothbrushes readily available, i.e. by removing cover 14. The container is large enough that a tube of toothpaste can also be stored within the container below plate 12.

What is claimed:

1. A free-standing covered container for storing toothbrushes, comprising a first elongated plastic tube having an upper end and a lower end; a flat plastic walls element closing the lower end of said tube; a second relatively short plastic tube telescopically inserted into the upper end of the first tube, said second tube having an outer surface adhesively secured to the inner surface of said first tube, said second tube having an upper end extending above the upper end of the first tube so that an outer side surface of the second tube is exposed; a multiple number of ledge elements secured to the inner surface of said second tube at regularly-spaced points therearound; a flat plastic plate removably fitting within the second tube on the ledge elements; said plastic plate having a centrally located hole therethrough adapted to accommodate the fingers of a person's hand for removing the plate from within the second tube; said plate having a multiple number of openings located near its peripheral edge and adapted to individually receive the handle portions of toothbrushes, whereby the brush portions of the toothbrushes are located above the plate; and a cover for the container, said cover comprising a third plastic tube having the same diameter as the first tube, and a second flat plastic wall element closing one end of said third tube with the other end left open; said cover being adapted to have its other end inserted onto the container so that an inner surface of the third plastic tube is in frictional facial contact with the exposed side surface of the second tube; said third plastic tube having an outer side surface that forms a smooth planar continuation of the outer surface of the first tube when the cover is positioned on the container; and a multiple number of vent slots extending through the wall of the third plastic tube, each vent slot extending angularly through the tube wall, each vent slot being narrower than the wall thickness of the third plastic tube so that the slots are relatively inconspicuous.

2. The covered container of claim 1, wherein said central hole in the plastic plate comprises two spaced-apart semi-circular hole portions and an intervening oval hole portion, said semi-circular hole portions being sized to snugly engage the first and third fingers of a person's hand, the intervening hole portion being adapted to have clearance with respect to the person's second finger.

3. The covered container of claim 2, wherein each tube has a square cross-section.

* * * * *